US011098709B2

(12) United States Patent
Obrejanu et al.

(10) Patent No.: US 11,098,709 B2
(45) Date of Patent: Aug. 24, 2021

(54) METHOD AND APPARATUS FOR PUMPING FLUID

(71) Applicant: FLUIDSTREAM ENERGY INC., Calgary (CA)

(72) Inventors: Marcel Obrejanu, Calgary (CA); Farhan Farshori, Calgary (CA)

(73) Assignee: Fluidstream Energy Inc., Calgary (CA)

( * ) Notice: Subject to any disclaimer, the term of this patent is extended or adjusted under 35 U.S.C. 154(b) by 0 days.

(21) Appl. No.: 14/188,500

(22) Filed: Feb. 24, 2014

(65) Prior Publication Data

US 2015/0240799 A1 Aug. 27, 2015

(30) Foreign Application Priority Data

Feb. 21, 2014 (CA) ..... CA 2843321

(51) Int. Cl.
*F04B 49/00* (2006.01)
*F04B 49/20* (2006.01)
(Continued)

(52) U.S. Cl.
CPC ..... *F04B 49/002* (2013.01); *F04B 49/065* (2013.01); *F04B 49/12* (2013.01);
(Continued)

(58) Field of Classification Search
CPC ..... F04B 49/065; F04B 49/008; F04B 49/12; F04B 49/20; F04B 2201/0202;
(Continued)

(56) References Cited

U.S. PATENT DOCUMENTS 1,508,623 A 9/1924 Somervell
2,835,228 A 5/1958 Parr
(Continued)

FOREIGN PATENT DOCUMENTS

WO 2009/097338 A2 8/2009
WO WO 2012120307 A2 * 9/2012 ..... E21B 33/0355

OTHER PUBLICATIONS

Casey, B., "Insider Secrets to Hydraulics," <http://www.insidersecretstohydraulics.com/hydraulic-power-unit. html> [retrieved Oct. 3, 2013], 3 pages.

*Primary Examiner* — Christopher S Bobish
(74) *Attorney, Agent, or Firm* — Christensen O'Connor Johnson Kindness, PLLC

(57) ABSTRACT

There is provided a method of transporting fluid produced from a fluid source having a source pressure to a fluid destination having a destination pressure rating. The method has the steps of determining a compressor power requirement based on the destination pressure rating and an estimated rate of flow. A compressor having a power rating that is less than the determined compressor power requirement is provided. An input of the compressor is connected to the fluid source and connecting an output of the compressor to the fluid destination. The compressor is operated in a high volume mode for a first portion of a compression stroke path and in a low volume move for a remainder of the compression stroke path such that the compressor simulates the output from a compressor with higher power rating.

19 Claims, 4 Drawing Sheets

(51) Int. Cl.
*F04B 49/12* (2006.01)
*F04B 49/06* (2006.01)

(52) U.S. Cl.
CPC ..... *F04B 49/20* (2013.01); *F04B 2201/0202* (2013.01); *F04B 2205/03* (2013.01); *F04B 2205/09* (2013.01); *F04B 2207/047* (2013.01)

(58) Field of Classification Search
CPC ..... F04B 2205/03; F04B 2205/09; F04B 2207/047; F04B 35/008; F04B 49/002
USPC ..... 417/53
See application file for complete search history.

(56) References Cited

U.S. PATENT DOCUMENTS 3,163,115 A 12/1964 Neff
3,183,840 A * 5/1965 Conover ..... F01L 25/063 417/216
3,250,227 A 5/1966 Kouns
3,489,094 A 1/1970 Vaughan
3,510,231 A 5/1970 Bobst
3,740,167 A 6/1973 Albrecht
4,543,044 A * 9/1985 Simmons ..... F04B 9/1176 417/342
4,653,986 A 3/1987 Ashton
4,990,058 A * 2/1991 Eslinger ..... F04B 9/113 417/18
5,246,076 A 9/1993 Watson
5,267,441 A * 12/1993 Devier et al. ..... 60/452
5,660,532 A * 8/1997 Castel ..... F04B 9/1172 417/342
6,015,270 A * 1/2000 Roth ..... F04B 3/00 417/259
6,059,539 A * 5/2000 Nyilas ..... E21B 43/01 417/228
6,547,514 B2 * 4/2003 Lee ..... F04D 13/14 415/1
7,373,971 B2 5/2008 Montgomery
7,766,079 B2 * 8/2010 Hoffarth ..... E21B 43/129 166/68.5
8,505,332 B1 * 8/2013 Prim ..... C10L 3/104 585/802
9,140,106 B2 * 9/2015 Rexilius ..... E21B 43/121
9,309,732 B2 * 4/2016 Boyd ..... E21B 21/063
2005/0072800 A1 * 4/2005 Smith ..... B67D 1/107 222/129.2
2005/0180864 A1 * 8/2005 Ursan ..... F04B 9/107 417/390
2006/0140791 A1 6/2006 Deming
2008/0262737 A1 10/2008 Thigpen
2009/0000790 A1 1/2009 Bertane
2010/0322791 A1 * 12/2010 Wadsley ..... F04B 1/28 417/286
2011/0259607 A1 10/2011 Carisella
2012/0205119 A1 8/2012 Wentworth
2012/0298375 A1 11/2012 Krauss
2013/0022476 A1 1/2013 Villareal
2014/0334947 A1 * 11/2014 Hackett ..... F04B 39/14 417/214
2015/0078917 A1 * 3/2015 Torrey ..... F04D 15/0066 417/42
2017/0321698 A1 * 11/2017 Holtzapple ..... F01C 1/10

* cited by examiner

METHOD AND APPARATUS FOR PUMPING FLUID

TECHNICAL FIELD

This relates to an apparatus and method for transporting fluid from a fluid source to a fluid destination.

BACKGROUND

Oilfield systems commonly use pumps in order to produce fluids from a fluid source, such as an oil well. There are many types of pumps used for fluid, and developing an efficient and cost effective pump is an ongoing challenge.

SUMMARY

According to an aspect, there is provided a method of transporting fluid produced from a fluid source having a source pressure to a fluid destination having a destination pressure rating, the method having the steps of determining a compressor power requirement based on the destination pressure rating and an estimated rate of flow of fluid from the fluid source to the fluid destination, providing a compressor having a power rating that is less than the determined compressor power requirement, connecting an input of the compressor to the fluid source and connecting an output of the compressor to the fluid destination, and operating the compressor in a high volume mode for a first portion of a compression stroke path and in a low volume move for a remainder of the compression stroke path such that the compressor simulates the output from a compressor having a power rating that is at least equal to the compressor power requirement, wherein in the high volume mode the compressor compresses fluid at a higher speed and a lower pressure relative to the low volume mode.

According to another aspect, the compressor may have a controller that controls the mode of the compressor. The controller may have a computer processor. The method may further comprise the step of instructing the computer processor to characterize at least one of the fluid source, the fluid destination and the compressor based on readings from one or more sensors, and controlling at least the mode of the compressor.

According to another aspect, the controller may switch the compressor to the low volume mode when a predetermined pressure is achieved within the compressor, when a predetermined point of the compression stroke path has been reached, or when the driver of the compressor experiences a predetermined load.

According to another aspect, the compressor may have a driver that drives the hydraulic cylinder in the high volume mode and the low volume mode. The driver may have a motor and a hydraulic pump that drives the compressor. The motor may comprise a variable frequency drive.

According to another aspect, the compressor may have a hydraulic cylinder driven by the hydraulic pump. The hydraulic cylinder may be a double-acting cylinder. The compressor may be a two-stage compressor and may have first and second hydraulic cylinders.

According to another aspect, the compressor may have a high volume hydraulic pump and a high pressure hydraulic pump, where the high volume mode may be achieved by operating at least the high volume pump and the low volume mode may be achieved by operating only the high pressure pump, the high volume hydraulic pump pumping hydraulic fluid at a higher rate and a lower pressure than the high pressure hydraulic pump.

According to another aspect, the high volume pump and the high pressure pump may operate continuously and the low volume mode may be achieved by a switching valve that causes the high volume pump to pump into a hydraulic reservoir.

According to another aspect, the fluid source may be a hydrocarbon well or casing gas.

According to another aspect, the method may have the further steps of measuring the casing gas pressure using a sensor connected to provide pressure measurements to the controller and programming the controller to adjust the speed of the compressor to maintain a desired casing gas pressure.

According to another aspect, the fluid destination may be a gas pipeline.

The aspects above may be combined with other aspects except where the aspects are mutually exclusive.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A method of transporting fluid produced from a fluid source having a source pressure to a fluid destination having a destination pressure rating will now be described with reference to FIGS. 1 through 4C.

Figure 1:
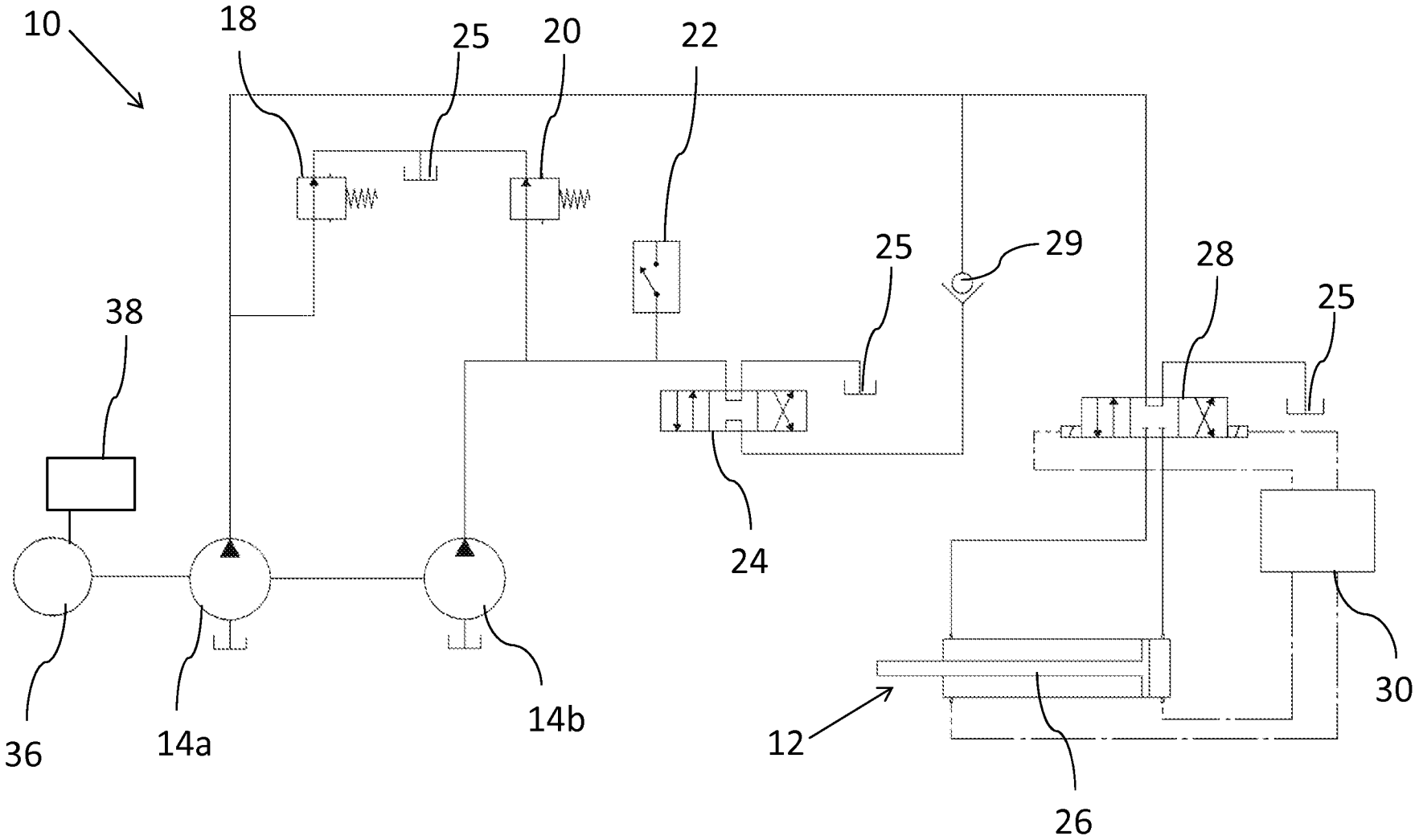
FIG. 1 is a schematic of the hydraulic cylinder circuit.

Structure and Relationship of Parts:

Referring to FIG. 1, an apparatus for pumping fluid, generally indicated by reference numeral 10, will be described. Apparatus 10 uses a compressor 12 to compress a compressible fluid, such as a gas, to a working pressure for transport or storage.

Figure 4A:
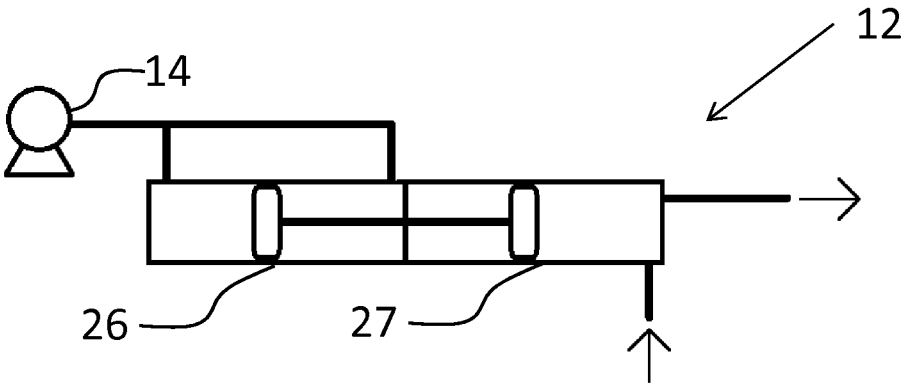
FIGS. 4A, 4B and 4C show different compressor configurations.
Figure 4B:
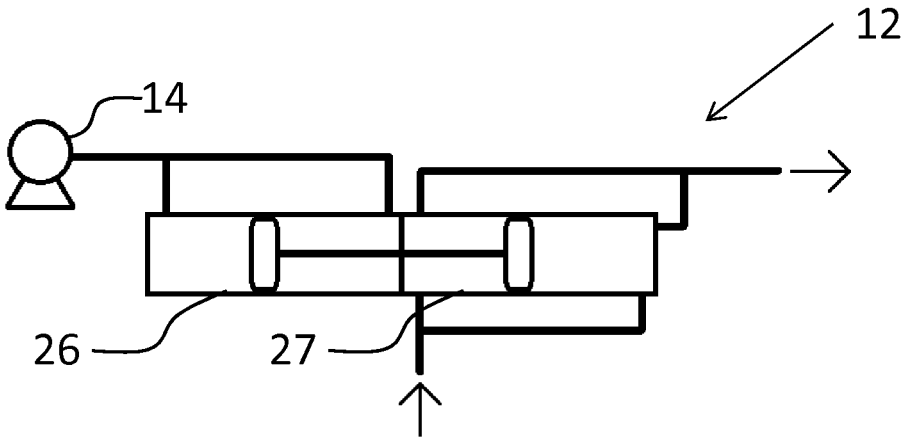
Figure 4C:
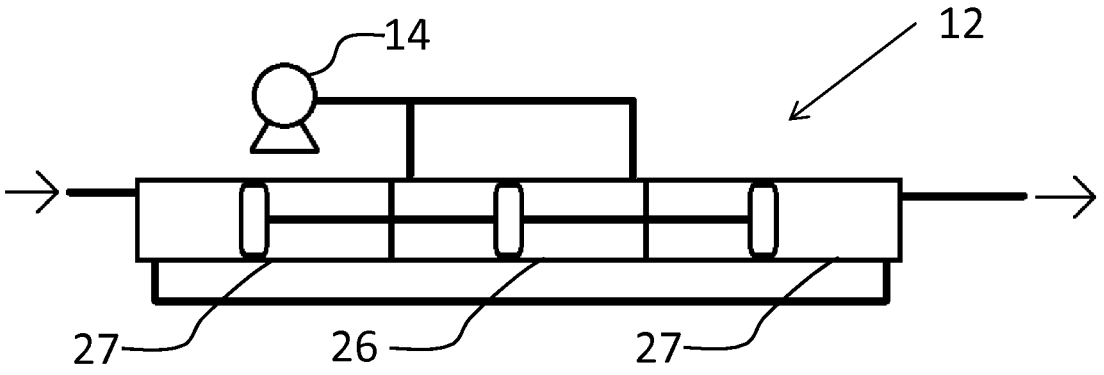

It will be understood that compressor 12 may take various forms. Preferably, and as described below, compressor 12 is a linear compressor with a reciprocating piston within a hydraulic cylinder and driven by a hydraulic pump. As shown in FIGS. 4A-4C, compressor 12 has a hydraulic cylinder 26, and a compressing cylinder 27, where hydraulic cylinder 26 drives compressing cylinder 27 to compress the fluids to be compressed. It will be understood that compressor 12 may take various forms and designs. For example, compressor 12 may have a single acting cylinder (as shown in FIG. 4A), or a double-acting cylinder (as shown in FIG. 4B), where fluid is pumped as the piston moves in both directions. Other configurations may include a two-stage compressor (as shown in FIG. 4C), where the fluid is compressed to a certain pressure in a first cylinder and then compressed to a higher pressure in a second hydraulic cylinder. These and other types of hydraulic cylinders are well known configurations. It will be appreciated that, in the discussion below, the design will account for the type of compressor 12 and the principles will be applied accordingly.

Figure 3:
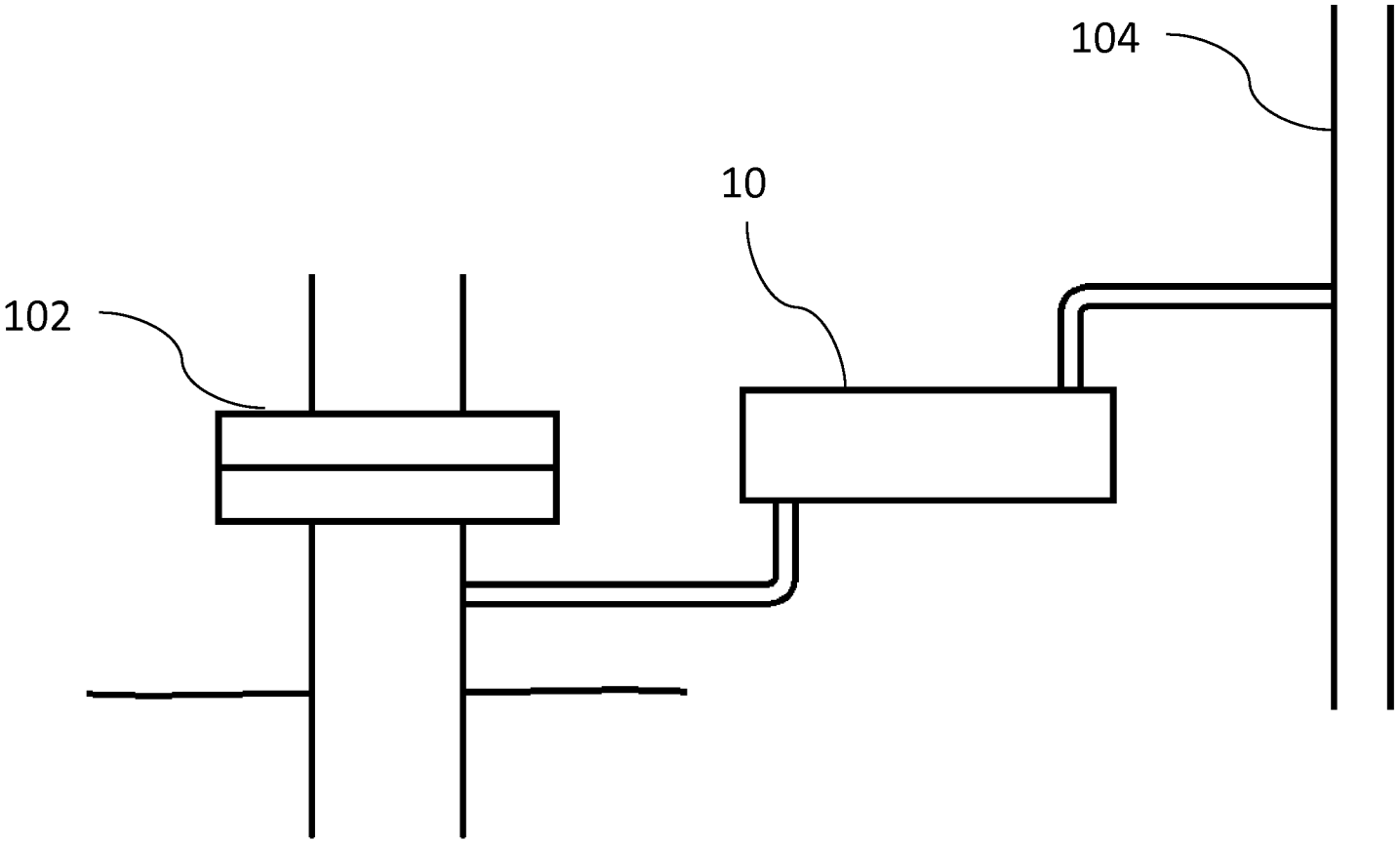
FIG. 3 is a schematic of an apparatus for pumping fluid on a well site.

Apparatus 10 may be used in various situations, and is intended to replace other compressors known in the art use to compress and transport gas. One example is shown in FIG. 3, where apparatus 10 is used to compress gas, such as casing gas or other gases from an oil well 102. This may be compressed and pumped into a pipeline 104 as shown, but may also be pumped onto other containers or destinations as is known in the art.

Referring now to FIG. 1, an example schematic for apparatus 10 is shown. In the depicted example, compressor 12 is connected to a hydraulic cylinder circuit that is powered by a motor 36 that moves hydraulic cylinder 26 using a hydraulic pump 14 that provides a high pressure mode and a high volume mode. The high volume mode pumps at a higher rate, but at a lower pressure than the high pressure mode. As shown, these two modes are provided by using a high pressure pump 14*a* and a high volume pump 14*b* in tandem. This allows for two modes. It will be understood that compressor 12 may be powered by other configurations that may provide additional pressure modes, or to provide the two modes in other ways. Preferably, the modes merely adjust the balance between volume and pressure, such that the same power is used in the different modes. By doing so, the total power requirement can be reduced, as will be described below. In the depicted embodiment, each pump 14*a* and 14*b* operates continually, with high volume pump 14*b* being removed from the circuit, such as by diverting it to tank 25, to switch between a high volume and a high pressure mode. High pressure pump 14*a* and high volume pump 14*b* are connected to pressure relief valve 18 and 20, respectively.

Compressor 12 has a stroke length that compresses the fluid to be compressed. It will be understood that, at the beginning of the stroke, the pressure is lower and the pressure increases to the maximum pressure at the end of the stroke. Accordingly, high volume pump 14*b* is used to operate compressor 12 in a high volume mode for a first portion of a compression stroke path when the pressure of the compressible fluid is low. As pressure builds, pressure switch 22 and switching valve 24 are used to change compressor 12 to operating in a low volume mode for the remainder of the compression stroke path, using only high pressure pump 14*a*. Hydraulic cylinder circuit 10 also has a main valve 28 and a limit switch relay circuit 30 that controls the direction of hydraulic cylinder 26. In some embodiments, high volume pump 14*b* and high pressure pump 14*a* operate continuously and the low volume/high pressure mode is achieved by a switching valve 24 that causes high volume pump 14*b* to pump into a hydraulic reservoir 25. As will be understood, the effect of high pressure pump 14*a* will be minimal when compressor 12 is in the high volume mode in which high volume pump 14*b* is operating. By removing high volume pump 14*b* from the circuit, i.e., by having it pump to a reservoir 25, only high pressure pump 14*a* is active. A check valve 29 is provided that prevents high pressure hydraulic oil from being diverted through switching valve 24 into hydraulic reservoir 25. As shown in FIG. 1, there may be multiple points in the system where there is a connection to hydraulic reservoir or tank 25. Preferably, there is only one hydraulic tank connected to apparatus for pumping fluid 10, having multiple connection points as needed. Various methods of connecting to hydraulic reservoir 25 are known in the art.

Figure 2:
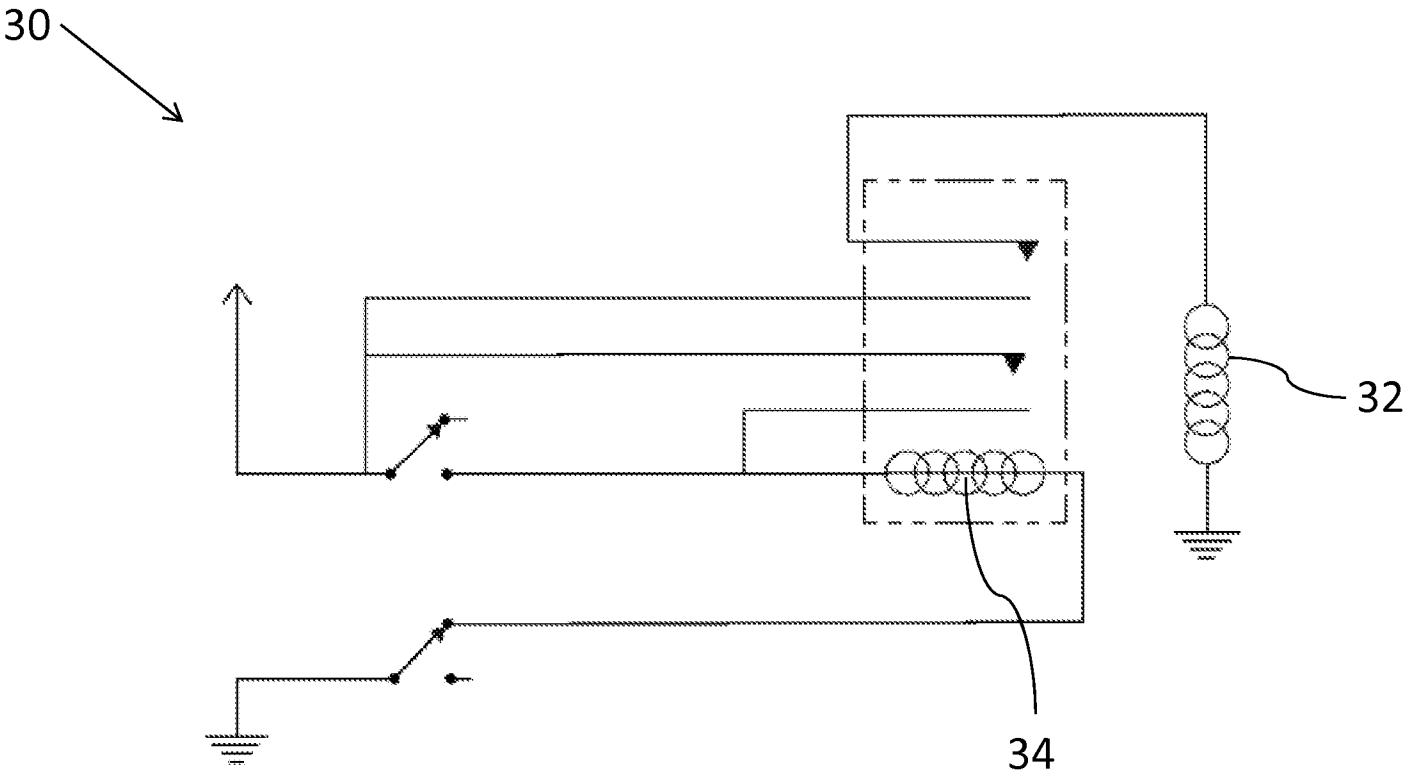
FIG. 2 is a schematic of the relay circuit.

Referring to FIG. 2, the limit switch relay circuit 30 has a main valve solenoid 32 and a limit switch relay 34.

In order to transport fluid produced from a fluid source having a source pressure to a fluid destination having a destination pressure rating, such as between hydrocarbon well 102 and pipeline 104 as shown in FIG. 3, it is first necessary to determine the power requirement of the compressor for the system. This will be based on the destination pressure rating and the estimated rate of flow of fluid from the fluid source to the fluid destination. The present apparatus 10 allows the actual compressor to have a power rating that is less than the determined compressor power requirement. This is due to the design that has the first portion of the compression stroke path to be powered by a high volume, low pressure mode, and then powered by a low volume, high pressure mode at the end of the compression stroke path. By only using the high pressure mode at the end of the stroke length, the amount of power required to power the system can be reduced. This also provides other advantages, as will be described below.

Referring to FIGS. 4A-4C, the input of compressor 12 is connected to the fluid source, and the output of the compressor is connected to the fluid destination. As shown in the example depicted in referring to FIG. 1, compressor 12 is operated in a high volume mode using high volume pump 14*b* for the first portion of a compression stroke path. The compressor mode is then switched using pressure switch 22 and switching valve 24 to a low volume mode using high pressure pump 14*a* for the remainder of the compression stroke path. This allows for a high volume mode to be achieved by operating at least the high volume pump 14*b* of any configuration used, and the low volume mode to be achieved by operating only the high pressure pump 14*a* of any configuration used, where the high volume hydraulic pump 14*b* pumps hydraulic fluid at a higher rate and a lower pressure than the high pressure hydraulic pump 14*a*. In some embodiments, the high volume pump 14*b* and the high pressure pump 14*a* operate continuously and the low volume mode is achieved by a switching valve 24 that causes the high volume pump 14*b* to pump into a hydraulic reservoir 25.

Referring to FIG. 1, high pressure pump 14*a* is in operation for the entire compression stroke path of compressor 12, while high volume pump 14*b* is only used in the portion of the compression stroke path where the pressure is low. In order to "deactivate" high volume pump 14*b* a switch may be adjusted such that it pumps into hydraulic reservoir 25 during the portion of the compression stroke path where the resistance pressure is high. The use of the high volume and low volume modes allows for the compressor to simulate the output from a compressor having a power rating that is at least equal to the compressor power requirement, as in the high volume mode the compressor compresses fluid at a higher speed and a lower pressure relative to the low volume mode. In some embodiments, the compressor 12 may have a driver that drives the hydraulic cylinder 26 in the high volume mode and the low volume mode. This driver may be a motor 36 and a hydraulic pump, or another driver method as known in the art. The motor 36 may also have a variable frequency drive. The compressor may have a hydraulic cylinder 26 driven by the hydraulic pump, and this hydraulic cylinder 26 may be a double-acting cylinder. In some embodiments, the compressor may be a two-stage compressor and have a first and a second hydraulic cylinder.

There are various ways in which the compressor may be switched between the low volume mode and the high volume mode, as will be understood by one skilled in the art.

In order to switch between modes, compressor 12 may have a controller 38 that controls the compressor mode, which may, for example, be a computer processor. In embodiments where controller 38 is a computer processor, the computer processor may be instructed to characterize at least one of the fluid source, the fluid destination and the compressor based on readings from one or more sensors. These sensors may measure the intake pressure, discharge pressure, discharge temperature, gas flow, motor current draw, motor rotations per minute, hydraulic oil temperature, hydraulic oil pressure, any combination of these, or other measurable properties of a compressor as are known in the art. The readings from these sensors can then be used to control at least the mode of the compressor, that is, if it is operating on a high volume or low volume mode. For example, by measuring the pressure within compressor 12, controller 38 may switch to the low volume mode when a predetermined pressure was achieved within compressor 12. One advantage of this is that it accounts for the liquid content of the fluid being pumped, as an increase in incompressible liquids will cause a higher pressure increase prior to the compressor reaching the end of its stroke, as at the end of the compression stroke path the compressor would experience higher pressures due to the liquid filling the remaining volume in the cylinder. Controller 38 may also monitor the compression stroke path and switch the compressor to the low volume mode once a predetermined point of the compression stroke path is reached, based on the estimated pressures within the compression cylinder of compressor 12. Alternatively, controller 38 may switch to the low volume mode when a predetermined load is experienced by the driver, such as a load experienced by motor 36 or high volume pump 14*b*. As a further example, there may be sensors that measure the casing gas pressure and provide these pressure measurements to controller 38, where controller 38 would be programmed to adjust the speed of the compressor to maintain a desired casing gas pressure. Sensors may also be used to detect the necessary readings in order to calculate the compression ratio. The maximum compression ratio that the system can be used at without overheating can be determined, and controller 38 can be used to dynamically adjust the pressure to ensure that the system is not overheated. Another possibility is the use of a horsepower limiting hydraulic pump, where controller 38 limits the horsepower at high pressures. The controller 38 may also have the ability to record the data from the sensor readings to provide a user with a history on how the system has performed relative to the environment. These data may also be transmitted to a user in another location, for example, by wireless communication with a user's computer or mobile device. This would allow a user to monitor the system remotely.

Operating Principles:

Generally speaking, the horsepower required to drive a compressor is calculated based on the output pressure to be achieved and the rate of flow required. An estimation of the amount of horsepower required to drive a particular pump on a particular well may be obtained from charts or from formulae. This type of calculation is well known in the industry, and may take the following form:

$P_{HP}$=EQrp, where:

$P_{PH}$=power of the pump (hp)

r=rate of flow (gpm)

p=output pressure (psi)

E=pump efficiency (generally between 80-95%)

Q=a multiplying factor (generally in the range of 0.0006-0.0007 when using the units given above).

The calculation may also vary depending on the type of power supply being used. A typical compressor package for an oil well site will include a hydraulic pump connected to an electric motor, or any other drive mechanism.

Advantages:

The principles described above allow the power requirements to be reduced, such that a motor with a lower horsepower rating may be substituted for a motor with a higher power rating calculated based on the peak pressure, as would be normally used.

Another advantage to this approach is that the high pressure, low volume mode allows liquids to be handled more effectively. Liquids are effectively non-compressible and as a result, they effectively reduce the compression cavity within the compressor until they can be pushed out of the cavity and cause the pressure to increase more rapidly than the compressor may be designed for. They also take longer to push out of the compressor as they are incompressible. This can cause damage to the compressor when a significant amount of liquid is encountered. By slowing the stroke speed of the compressor toward the end of the stroke, and preferably when a high pressure is sensed, more time is given to allow the liquid to exit the compressor and the rapid increase in pressure can be reduced or avoided. This also protects the compressor cylinder from being over-pressurized.

Furthermore, by adjusting the speed of compressor 12, which may also include the distance of the stroke length for each of the modes as well as the overall speed of each mode, the rate at which the fluid is pumped is controlled. When this relates to casing gas, it allows the casing gas pressure to be regulated within a desired pressure range.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A method of transporting fluid produced from a fluid source having a source pressure to a fluid destination having a destination pressure rating, the method comprising the steps of:

connecting an input of a compressor to the fluid source and connecting an output of the compressor to the fluid destination;

inputting fluid from the fluid source into the input of the compressor, the fluid comprising a liquid phase and a gaseous phase;

operating the compressor in a high volume mode for a first portion of a compression stroke path within a compression chamber of the compressor; and detecting the presence of liquid in the compression chamber using readings from one or more sensors, wherein the presence of liquid reduces an effective volume of the compression chamber that is reflected in the readings from the one or more sensors; and when liquid is detected, changing the operation of the compressor to a low volume mode for a remainder of the compression stroke path to allow the liquid to exit the compression chamber at a reduced rate via the output, the high volume mode compressing the fluid to a first pressure, and the low volume mode compressing the fluid to a second pressure that is higher than the first pressure, wherein in the high volume mode the compressor compresses fluid at a higher speed and a lower pressure relative to the low volume mode.

2. The method of claim 1, wherein the compressor further comprises a controller that controls the mode of the compressor.

3. The method of claim 2, wherein the controller comprises a computer processor.

4. The method of claim 3, comprising the steps of:

instructing the computer processor to characterize at least one of the fluid source, the fluid destination and the compressor based on readings from the one or more sensors; and controlling at least the mode of the compressor.

5. The method of claim 2, wherein the controller switches the compressor to the low volume mode when a predetermined pressure is achieved within the compressor.

6. The method of claim 2, wherein the controller switches the compressor to the low volume mode if the compressor is in the high volume mode once a predetermined point of the compression stroke path has been reached.

7. The method of claim 1, wherein the compressor comprises a driver that drives the compressor in the high volume mode and the low volume mode.

8. The method of claim 7, wherein the compressor further comprises a controller that switches the compressor to the low volume mode when the driver experiences a predetermined load.

9. The method of claim 7, wherein the driver comprises a motor and a hydraulic pump that drives the compressor.

10. The method of claim 9, wherein the motor comprises a variable frequency drive.

11. The method of claim 9, wherein the compressor comprises a hydraulic cylinder driven by the hydraulic pump.

12. The method of claim 11, wherein the hydraulic cylinder is a double-acting cylinder.

13. The method of claim 9, wherein the hydraulic pump comprises a high volume hydraulic pump and a high pressure hydraulic pump, wherein the high volume mode is achieved by operating at least the high volume hydraulic pump and the low volume mode is achieved by operating only the high pressure hydraulic pump, the high volume hydraulic pump pumping fluid at a higher rate and a lower pressure than the high pressure hydraulic pump.

14. The method of claim 13, wherein the high volume pump and the high pressure pump operate continuously and the low volume mode is achieved by a switching valve that causes the high volume pump to pump into a hydraulic reservoir.

15. The method of claim 1, wherein the fluid source is a hydrocarbon well.

16. The method of claim 1, wherein the fluid source is casing gas.

17. The method of claim 6, wherein the fluid source is casing gas, and further comprising the steps of:

measuring a casing gas pressure using a sensor connected to provide pressure measurements to the controller; and programming the controller to adjust the speed of the compressor by controlling the predetermined point along the compression stroke at which the operation of the compressor is changed to a low volume mode to maintain a desired casing gas pressure.

18. The method of claim 1, wherein the fluid destination is a gas pipeline.

19. The method of claim 1, wherein the one or more sensors measure a pressure at the input of the compressor, a pressure at the output of the compressor, a pressure of the compression chamber, a discharge temperature of the compressor, a gas flow rate through the compressor, a current draw of a motor of the compressor, a motor speed of the motor of the compressor, a hydraulic oil temperature of the compressor, a hydraulic oil pressure of the compressor, or combinations thereof.

* * * * *